US005623126A

United States Patent [19]

Sherrill

[11] Patent Number: 5,623,126

[45] Date of Patent: Apr. 22, 1997

[54] CERAMIC TERMINAL ASSEMBLY

[75] Inventor: Jimmy L. Sherrill, Cookeville, Tenn.

[73] Assignee: Tutco, Inc., Cookeville, Tenn.

[21] Appl. No.: 297,852

[22] Filed: Aug. 30, 1994

[51] Int. Cl.[6] ..... H01B 17/26

[52] U.S. Cl. ..... 174/153 R; 174/167; 174/178; 439/870

[58] Field of Search ..... 174/153 R, 151, 174/153 G, 153 A, 167, 138 J, 176, 178; 439/870, 877, 879

[56] References Cited

U.S. PATENT DOCUMENTS

| | | | |
|---|---|---|---|
| 2,953,768 | 12/1960 | Miller | 339/131 |
| 3,284,605 | 11/1966 | Anderson et al. | 439/870 |
| 3,936,592 | 2/1976 | Gamble | 174/153 R |
| 4,182,928 | 1/1980 | Murphy et al. | 174/153 R |
| 4,343,530 | 8/1982 | Leger | 439/870 |
| 5,399,110 | 3/1995 | Morello et al. | 439/879 |

*Primary Examiner*—Kristine L. Kincaid
*Assistant Examiner*—Paramita Ghosh
*Attorney, Agent, or Firm*—Dickinson, Wright, Moon, Van Dusen & Freeman

[57] ABSTRACT

A terminal assembly is provided which is easy to assemble and disassemble. The assembly features male and female ceramic elements that interconnect and provide a passageway into which a terminal equipped with forward and rearward tabs is placed. After the terminal is positioned in the passageway, the forward tabs may be bent into a position at an angle to the terminal, thereby securing the terminal in place and holding the terminal assembly together. The male ceramic element is provided with a unique annular depression that reduces the amount of ceramic materials needed to make the assembly, while also providing the minimum surface spacing required by industry standards. In addition, the terminal assembly is provided with a v-shaped attachment element for conveniently attaching the assembly to a lead wire.

23 Claims, 4 Drawing Sheets

CERAMIC TERMINAL ASSEMBLY

TECHNICAL FIELD

This invention relates generally to the art of electric heaters, and in particular to a new, improved ceramic assembly for heating element terminals which has a flat profile.

BACKGROUND

Electrical terminal assemblies are widely used and are manufactured on a large scale. Many of the terminal assemblies presently known to the art are difficult to assemble and require expensive machinery and excessive worker hours to manufacture, thereby increasing their overall cost. There is thus a need for terminal assemblies that are easy to assemble.

Furthermore, virtually all of the terminal assemblies currently known to the art are difficult to disassemble. As a result, when manufacturing defects arise, they cannot be easily remedied at the manufacturing site, and often result in the disposal of the entire unit. This increases waste on the manufacturing side, which is ultimately reflected in the cost of the manufactured goods. Furthermore, the repair costs for products incorporating such assemblies is elevated, since the repair is more time consuming and frequently results in broken parts. In addition, since terminal assemblies are expensive to manufacture, there is a significant salvage value in used terminal assemblies. That salvage value is significantly decreased, however, if the assembly is not easily removable from the device in which it is installed. There is thus a need for terminal assemblies that are easy to disassemble, and that can be easily removed from devices in which they are installed.

To date, various terminal assemblies have been proposed in the prior art. However, none of these terminals can be readily assembled and disassembled. For example, one common terminal assembly consists of a threaded bolt on which is mounted a heating element sandwiched between two ceramic plates. The assembly is secured together by a first set of lock nuts, one disposed on the outer surface of each ceramic plate. A second set of lock nuts is provided adjacent to the first set to secure lead wires to the threaded bolt. Since the assembly or disassembly of such a system requires the placement or displacement of four lock nuts for each terminal assembly, the correction of manufacturing defects, as well as repair and salvage operations, are uneconomical in large scale operations.

Some of the more recent terminal assemblies have been designed to facilitate assembly. For example, U.S. Pat. No. 4,182,928 (Murphy et al.) proposes a heating element terminal assembly having a tubular terminal which terminates on one end in a flat blade. The terminal is inserted, tubular portion first, into the central bore of a two-piece ceramic mount, so that a segment of the tubular portion extends from the opposite end of the mount. Since the width of the blade is greater than the diameter of the central bore, the terminal inserts only as far as the blade. The segment of tubular portion extending from the mount is then crimped at a point immediately adjacent to the mount, thereby holding the assembly together.

While terminal assemblies such as that shown in Murphy et al. have the advantage of being easier to assemble than some other prior art units, assemblies of this type are difficult to disassemble, since this requires that the tubular portion of the terminal be uncrimped. In actual practice, it is more cost effective to simply break the terminal assembly each time disassembly is required (as when the heating element needs to be replaced in a heater that incorporates such an assembly) rather than to attempt to disassemble it.

A further feature of many prior art terminal assemblies which contributes to their manufacturing cost is the interface between the terminal and the lead wire. In many prior art devices, such as that disclosed in Murphy et al., the terminal is provided with a tubular portion into which a lead wire is inserted. The tubular portion is then crimped around the lead wire. This operation requires precise alignment of the lead wire with the tubular portion, much like the threading of a needle, and is impractical and time consuming in large scale operations. There is thus a need for a terminal assembly which is equipped with attachment means for engaging a lead wire that makes for easy alignment of the lead wire and the attachment means.

Yet another factor which increases the manufacturing cost of prior art terminal assemblies is their excessive use of materials. Safety standards in the electronics industry require a minimum surface spacing between live electrical parts, such as heating element terminals, and bare metal mounting structures, such as terminal plates disposed between ceramic insulator elements. To date, prior art terminal assemblies, such as that shown in Murphy et al., have met this minimum surface spacing requirement by using insulating elements that are sufficiently long or sufficiently wide to meet the spacing requirements. Such an approach involves an inherent waste of materials. There is thus a need for a terminal assembly which meets the surface spacing requirement without wasting materials.

SUMMARY OF THE INVENTION

In accordance with the present invention, a new, improved ceramic terminal assembly for heating elements and the like is provided. The assembly is provided with a terminal and male and female ceramic elements that are readily assembled into a unit, and that are also readily disassembled into their component parts. The invention is also equipped with attachment means for conveniently engaging a lead wire which does not require precise alignment of the lead wire and the attachment means, and therefore simplifies the incorporation of the assembly into a finished product. In addition, the male ceramic element of the assembly is provided with a unique annular depression which reduces the amount of expensive ceramic material needed to make the element, while at the same time providing the minimum surface spacing between live electrical parts and bare metal mounting structures required by industry safety standards.

DETAILED DESCRIPTION OF THE PREFERRED EMBODIMENT

Figure 1:
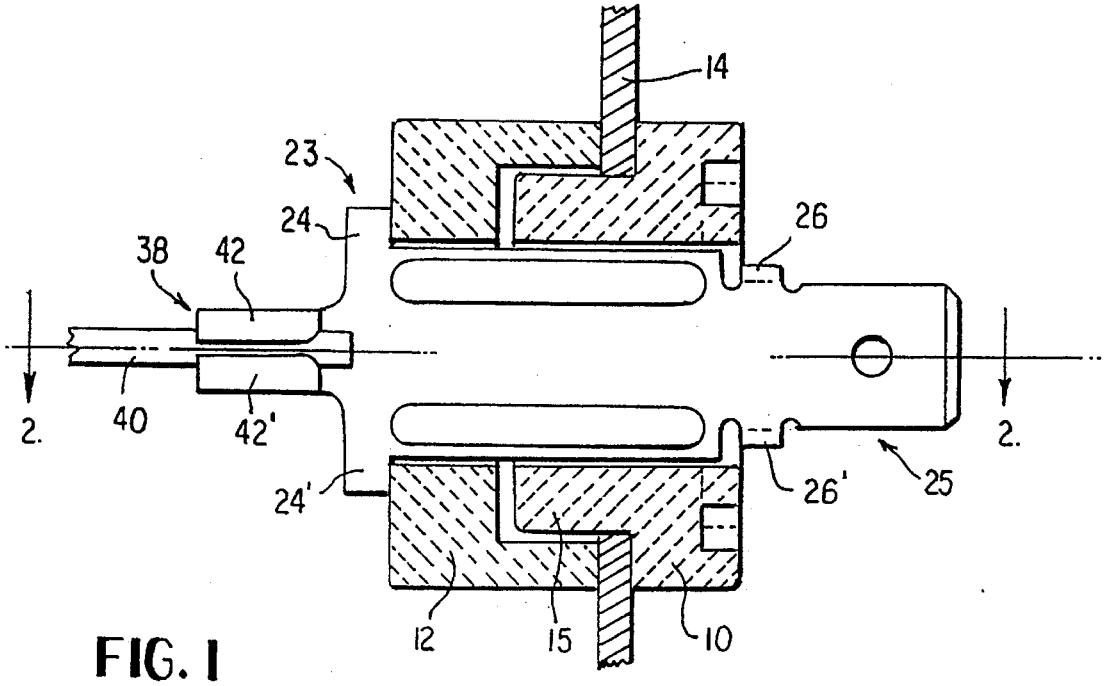
FIG. 1 is an exploded side view in section of the terminal assembly of the present invention.

FIG. 1 shows the preferred embodiment of the terminal assembly of the present invention. The assembly consists of interlocking male 10 and female 12 elements that are made out of a ceramic material or some other insulating, heat resistant material suitable for use with heating elements. The assembly is typically supported on a metal plate 14 provided with an opening which forms part of the framework for the product into which the assembly is installed. The male element is provided with a protrusion 15 which extends through the opening in the plate. The female element is equipped with a depression 17 suitably shaped to accept the protrusion of the male element.

Figure 2:
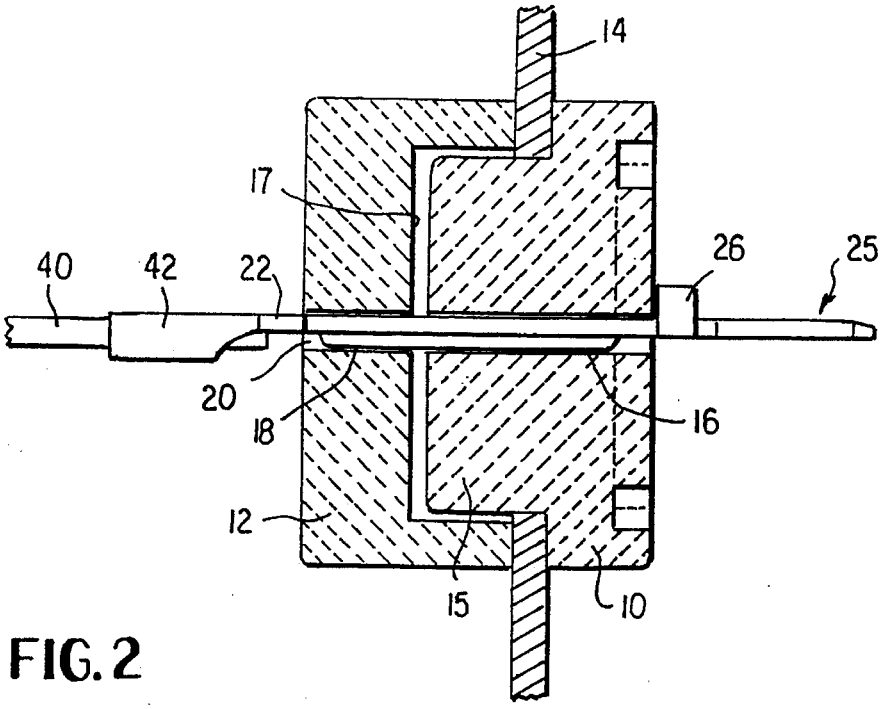
FIG. 2 is a side view in section along the line 2—2 of FIG. 1.

As shown in FIG. 2, both the male and female elements have slit-like, rectangular slots 16, 18 extending through their length which align to form a passageway 20 when the elements are fitted together. A substantially planar terminal 22 is inserted into the passageway. The terminal may be made out of any conductive material suitable for use with a heating element, including, but not limited to, steel and copper alloys.

As shown in FIG. 1, the rearward portion 23 of the terminal is fitted with rearward tabs 24, 24' that extend perpendicularly from the side of the terminal near the point at which the terminal is attached to the lead wire 40 of the device into which the ceramic assembly is incorporated. Since the combined width of the terminal and the rearward tabs exceeds the width of the passageway, these tabs prevent the terminal from entering the passageway beyond the point at which the tabs are attached.

The forward portion 25 of the terminal, which protrudes from the passageway, is fitted with forward tabs 26, 26'. The forward tabs lie within the plane of the terminal and are sufficiently short to allow the forward portion of the terminal to pass through the passageway. The forward tabs are sufficiently pliable so that, once the forward portion of the terminal has passed through the passageway, the forward tabs can be bent into a position at an angle to the plane of the terminal. In this way, the terminal is locked into place and cannot pass back through the passageway. Since the male and female elements are locked between the ends of the terminal when the forward tabs are so bent, the forward tabs also serve the additional purpose of helping to hold the ceramic assembly together.

Preferably, the ceramic assembly is put together in such a way that the male and female elements are separated by the metal plate, with the female element abutting the forward portion of the terminal and the male element abutting the rearward portion of the terminal. However, the construction of the assembly allows the positions of the male and female elements to be interchanged, so that the female element abuts the rearward portion of the terminal and the male element abuts the forward portion of the terminal.

Figure 3A:
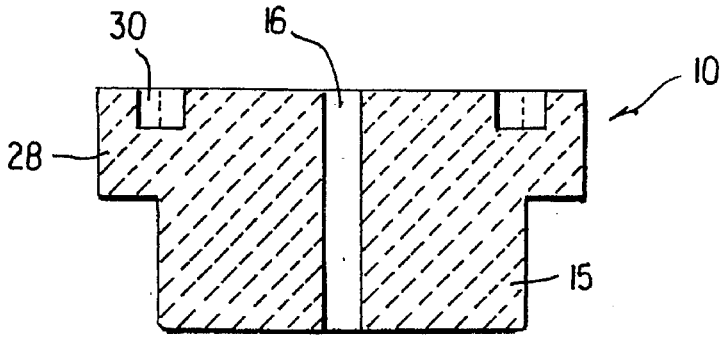
FIG. 3*a* is a side view in section of the male element.
Figure 3B:
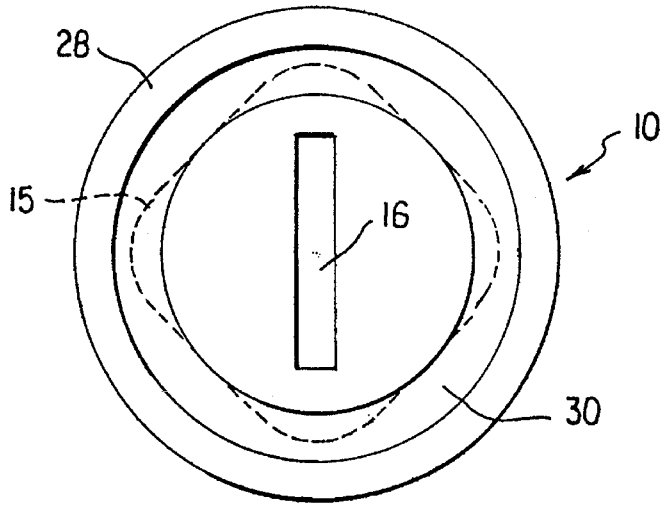
FIG. 3*b* is a top view of the male element.
Figure 3C:
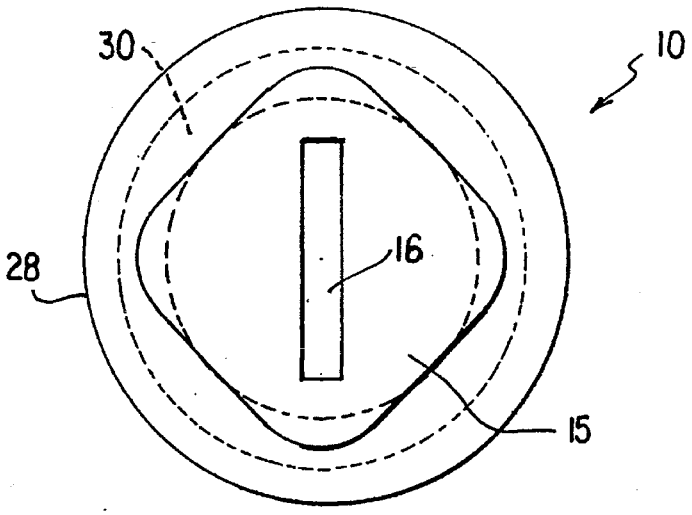
FIG. 3*c* is a bottom view of the male element.

FIGS. 3*a–c* show the male element 10. The male element has a rounded base 28 with an annular indentation 30, and is equipped with a protrusion 15 that extends from the base. A rectangular slot 16 extends through the center of the male element. Preferably, the protrusion on the male element is approximately polygonal in cross section to provide a means (i.e., at least one straight edge) by which the rotational movement of the male element about its axis, and the rotational movement of the assembly as a whole, may be arrested. In the most preferred embodiment, the protrusion is approximately square with rounded corners. The opening in the metal plate 14 is likewise preferably provided with at least one straight edge to engage the protrusion of the male element. In its most preferred embodiment, the opening is complimentary in shape to the cross-sectional shape of the protrusion.

The annular indentation on the top of the male element serves important economic and safety considerations. Safety standards in the electronics industry require a minimum surface spacing between live electrical parts, such as heating element terminals, and bare metal mounting structures, such as the terminal sandwiched between the male and female elements. The annular indentation allows the male element to be shorter than otherwise possible while still providing the minimum surface spacing required by safety standards, thereby reducing the amount of expensive ceramic materials needed to make the element.

Figure 4A:
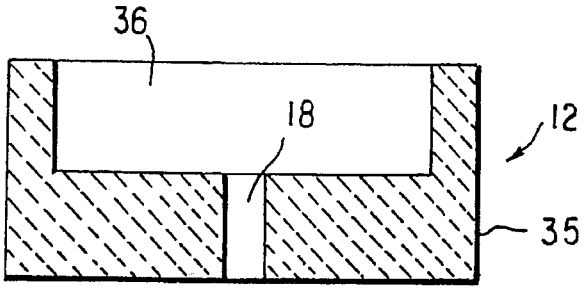
FIG. 4*a* is a side view in section of the female element.
Figure 4C:
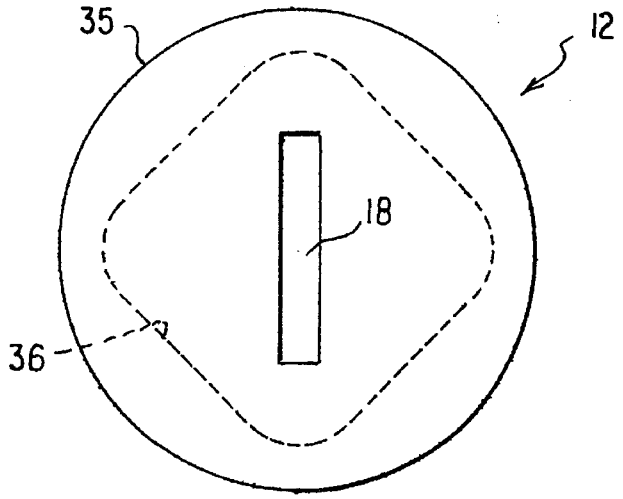
FIG. 4*c* is a bottom view of the female element.
Figure 4B:
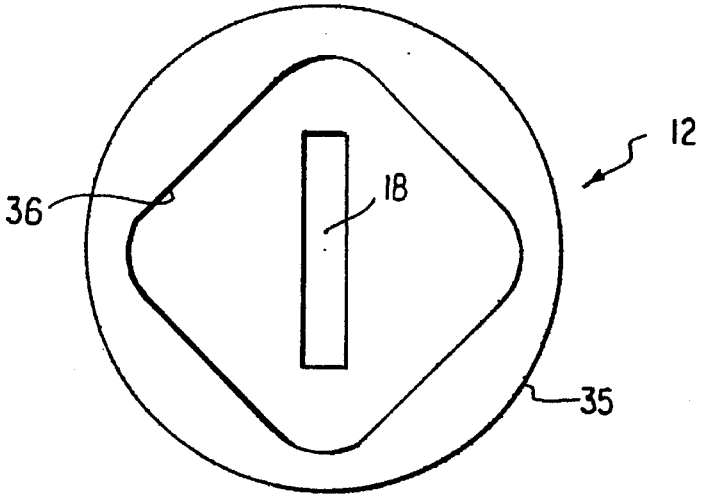
FIG. 4*b* is a top view of the female element.

FIGS. 4*a–c* show the female element 12. The female element has a cylindrical exterior 35 and is fitted with a depression 36 which is complimentary in shape to the protrusion of the male element. A rectangular slot 18 extends through the center of the female element. As with the male element, the female element may optionally be provided with one or more annular indentations on its exterior surface which reduce the amount of material used to make the element, while at the same time allowing the element to meet the minimum surface spacing requirements imposed by the industry.

Referring again to FIG. 1, an attachment means 38 is provided on the rearward portion of the terminal to attach the terminal to the lead wire 40 of a device into which the terminal assembly is incorporated. For example, the lead wire might be the end of a heating coil in an electric heater. While various attachment means can be used with the terminal assembly of the present invention, the preferred attachment means comprises a v-shaped tab. When it is desired to attach the terminal assembly to the lead wire, the lead wire is simply placed in the attachment means, and the walls 42, 42' of the attachment means are pressed or crimped together around the lead wire to provide a solid connection.

Figure 5:
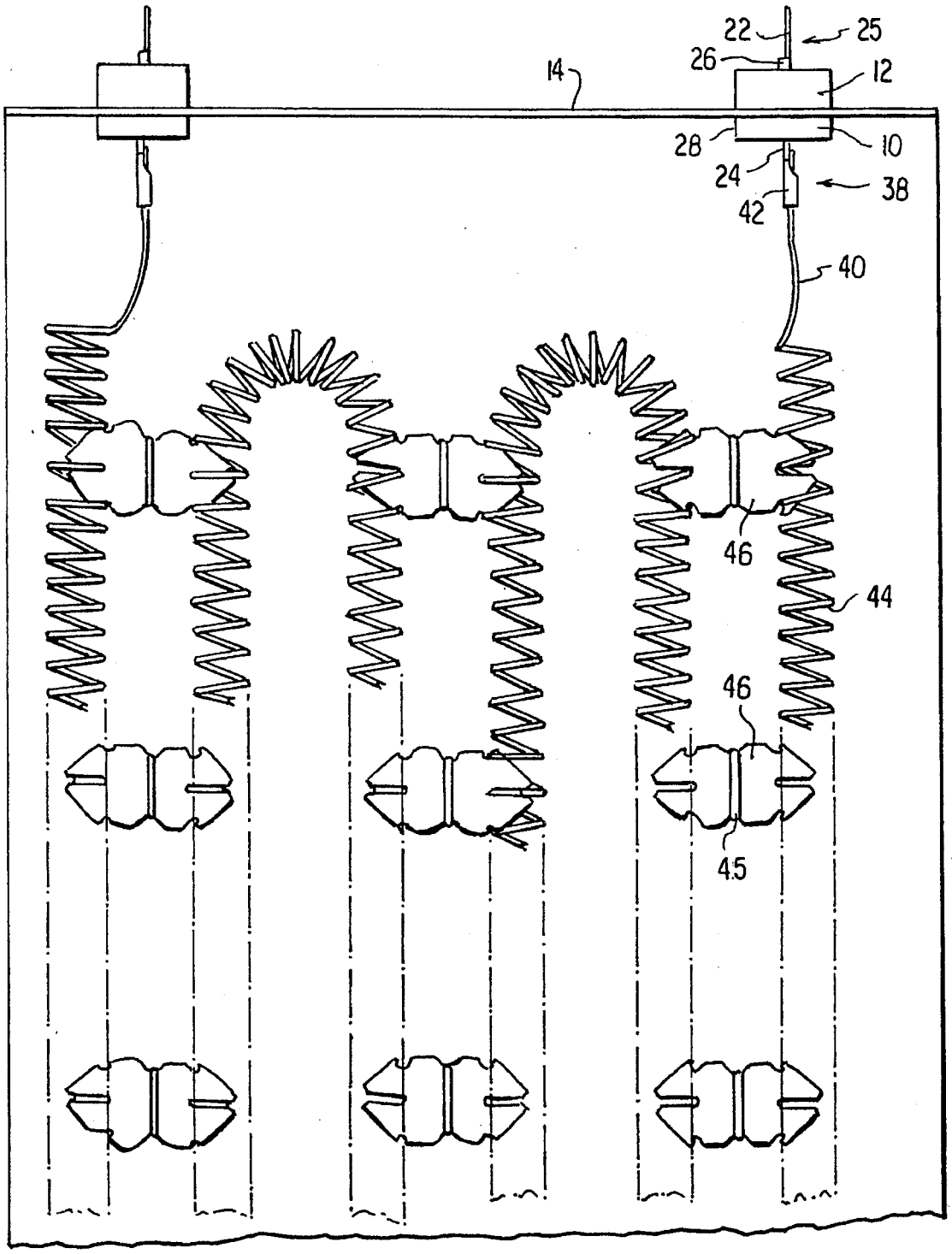
FIG. 5 is an elevated side view of the ceramic terminal assembly of the present invention shown incorporated into the heating element assembly of an electric heater.

FIG. 5 shows the device of the present invention incorporated into the heating element of an electric heater. The male 10 and female 12 elements are situated on opposite sides of a plate 14 that forms part of the support structure for the heating element assembly. The heating coils 44 of the assembly, which are shown in phantom, may depend from a series of rods 45 or other supporting elements which also form a portion of the support structure. The heating coils are separated from each other and from the support structure by a series of ceramic dividers 46. The heating coils form a continuous loop which terminates at each end in a lead wire 40. Each lead wire is connected by suitable attachment means 38 to a terminal 22 which is incorporated into the ceramic terminal assembly in accordance with the teachings of the present invention. As previously indicated, the attachment means is preferably a v-shaped tab whose walls 42, 42' are crimped together around the lead wire.

The above disclosure is intended only to convey an understanding of the present invention to those skilled in the art, and is not intended to be limiting. It will be appreciated that various modifications to the disclosed embodiments are possible without departing from the scope of the invention. Therefore, the scope of the present invention should be construed solely by reference to the appended claims.

I claim:

1. A terminal assembly, comprising:

a male element equipped with a base and a protrusion extending from said base, said male element having a first aperture extending through said base and said protrusion;

a female element equipped with a second aperture and having a depression for engaging said protrusion of said male element;

a substantially planar terminal which is inserted into a passageway formed by the alignment of said first and second apertures;

at least one rearward tab attached to a rearward portion of said terminal, said rearward tab being sufficiently long to arrest the forward passage of said terminal through said passageway;

at least one forward tab attached to a forward portion of said terminal, said forward tab being bendable into a position in which it arrests the rearward movement of said terminal through said passageway; and wherein said assembly has a means for preventing said male element from rotating.

2. The terminal assembly of claim 1, wherein a distance between said forward and rearward tabs is at least as great as a length of said passageway.

3. The terminal assembly of claim 1, wherein at least one of said first and second apertures is slit-like.

4. The terminal assembly of claim 3, wherein said terminal is substantially rectangular in shape.

5. The terminal assembly of claim 1, wherein said terminal is complimentary in shape to the shape of at least one of said first and second apertures.

6. The terminal assembly of claim 1, wherein said male and female elements are ceramic.

7. The terminal assembly of claim 1, wherein said male element has a protrusion that is approximately polygonal in cross section.

8. The terminal assembly of claim 7, wherein said protrusion has a cross section that is square with rounded corners.

9. The terminal assembly of claim 8, wherein said male element has a rounded base.

10. The terminal assembly of claim 1, wherein said depression in said female element is complimentary in shape to said protrusion on said male element.

11. The terminal assembly of claim 8, wherein the depression in said female element is square with rounded corners.

12. The terminal assembly of claim 11, wherein said female element has a rounded exterior.

13. The terminal assembly of claim 1, wherein said first aperture is symmetrically disposed about a center of said male element, and said second aperture is symmetrically disposed about a center of said female element.

14. The terminal assembly of claim 1, further comprising attachment means for attaching said assembly to a lead wire.

15. The terminal assembly of claim 14, wherein said attachment means comprises a v-shaped tab.

16. The terminal assembly of claim 1, wherein there are a plurality of said rearward tabs attached to a rearward portion of said terminal.

17. The terminal assembly of claim 1, wherein there are a plurality of forward tabs attached to a forward portion of said terminal, said forward tabs being bendable into a position in which they arrest rearward movement of said terminal through said first and second apertures.

18. The terminal assembly of claim 1, wherein the base of said male element is provided with an annular depression.

19. The terminal assembly of claim 1, wherein said forward tab is approximately rectangular and extends perpendicularly to a length of said terminal.

20. The terminal assembly of claim 1, wherein said rearward tab is approximately rectangular and extends perpendicularly to a length of said terminal.

21. A terminal assembly in combination with a support plate equipped with an opening for receiving said terminal assembly, the combination comprising:

a male element having a base that extends over said opening and a protrusion extending from said base through said opening, said male element being equipped with a first aperture that extends through said base and said protrusion;

a female element disposed on a side of said opening opposite said male element, said female element being equipped with a second aperture in alignment with said first aperture and having a depression for engaging said protrusion of said male element;

a flat terminal which is inserted into a passageway formed by alignment of said first and second apertures;

at least one rearward tab attached to a rearward portion of said terminal, said rearward tab being sufficiently long to arrest forward passage of said terminal through said passageway; and at least one forward tab attached to a forward portion of said terminal, said forward tab being bendable into a position in which it arrests rearward movement of said terminal through said passageway wherein a shape of said opening and a shape of said protrusion are such that said opening and said protrusion interlock to prevent said male element from rotating.

22. The combination of claim 21, wherein said protrusion and said opening are approximately rectangular in shape.

23. A terminal assembly, comprising:

a male element equipped with a rounded base and an approximately rectangular protrusion mounted on said base, said male element having a centrally disposed first aperture extending through said base and said protrusion;

a rounded female element equipped with a centrally disposed second aperture and an approximately rectangular depression for engaging said protrusion of said male element;

a flat terminal which slides through a passageway formed by alignment of said first and second apertures;

two rearward tabs attached to opposite sides of a rearward portion of said terminal, wherein the combined width of said rearward portion and a length of said rearward tabs is greater than a width of said first aperture, thereby arresting the forward passage of said terminal through said passageway; and two forward tabs attached to opposite sides of a forward portion of said terminal, said forward tabs being bendable into a position where they arrest the rearward movement of said terminal through said second aperture.

* * * * *